United States Patent [19]

Reuter

[11] Patent Number: 4,907,632

[45] Date of Patent: Mar. 13, 1990

[54] PROCESS AND APPARATUS FOR THE FEEDING OF TREE TRUNKS TO A PROCESSING MACHINE

[75] Inventor: Alfred Reuter, Oberkirch, Fed. Rep. of Germany

[73] Assignee: Gebrüder Linck Maschinenfabrik "Gatterlinck" GmbH & Co. KG, Oberkirch, Fed. Rep. of Germany

[21] Appl. No.: 223,064

[22] PCT Filed: Mar. 10, 1987

[86] PCT No.: PCT/EP87/00137

§ 371 Date: Apr. 29, 1988

§ 102(e) Date: Apr. 29, 1988

[87] PCT Pub. No.: WO87/05555

PCT Pub. Date: Sep. 24, 1987

[30] Foreign Application Priority Data

Mar. 11, 1986 [DE] Fed. Rep. of Germany ..... 3670980

[51] Int. Cl.[4] ..... B27C 9/04; B27B 1/00

[52] U.S. Cl. ..... 144/356; 144/3 R; 144/39; 144/246 R; 144/246 F; 144/357; 144/369; 198/624; 198/782

[58] Field of Search ..... 144/1 R, 3 R, 39, 41, 144/114, 117 R, 246 R, 246 E, 246 F, 356, 357, 369; 198/624, 782

[56] References Cited

U.S. PATENT DOCUMENTS

| | | | |
|---|---|---|---|
| 3,204,674 | 9/1965 | Griffin . | |
| 3,313,329 | 4/1967 | Mitten | 144/3 R |
| 3,373,782 | 3/1968 | Pease | 144/3 R |
| 3,738,404 | 6/1973 | Walker | 144/36 |
| 3,844,399 | 10/1974 | Sellers, Jr. et al. | 144/246 F |
| 3,934,630 | 1/1976 | Cockle | 144/3 R |
| 4,457,350 | 7/1984 | Finnila | 144/246 F |
| 4,589,456 | 5/1986 | Traben . | |
| 4,711,279 | 12/1987 | Reuter . | |

FOREIGN PATENT DOCUMENTS

| | | |
|---|---|---|
| 1628866 | 2/1972 | Fed. Rep. of Germany . |
| 3137401 | 4/1983 | Fed. Rep. of Germany . |
| 3246969 | 7/1983 | Fed. Rep. of Germany . |
| 2921458 | 2/1985 | Fed. Rep. of Germany . |

*Primary Examiner*—W. Donald Bray

*Attorney, Agent, or Firm*—Burns, Doane, Swecker & Mathis

[57] ABSTRACT

A tree trunk is fed to a cutting station along a centerline line by a plurality of groups of centering rolls spaced along the centering line. Some rolls are driven to advance the trunks. The groups of rolls are adjustable from a centering mode to a non-centering mode by either retracting the rolls or unloading the rolls. During the advancement of a trunk successively through the roll groups, the groups are successively adjusted between their centering and non-centering modes such that roll groups located to support front and rear ends of the trunk are in their centering modes, while at least one roll group disposed therebetween is in its non-centering mode.

9 Claims, 2 Drawing Sheets

Fig. 5
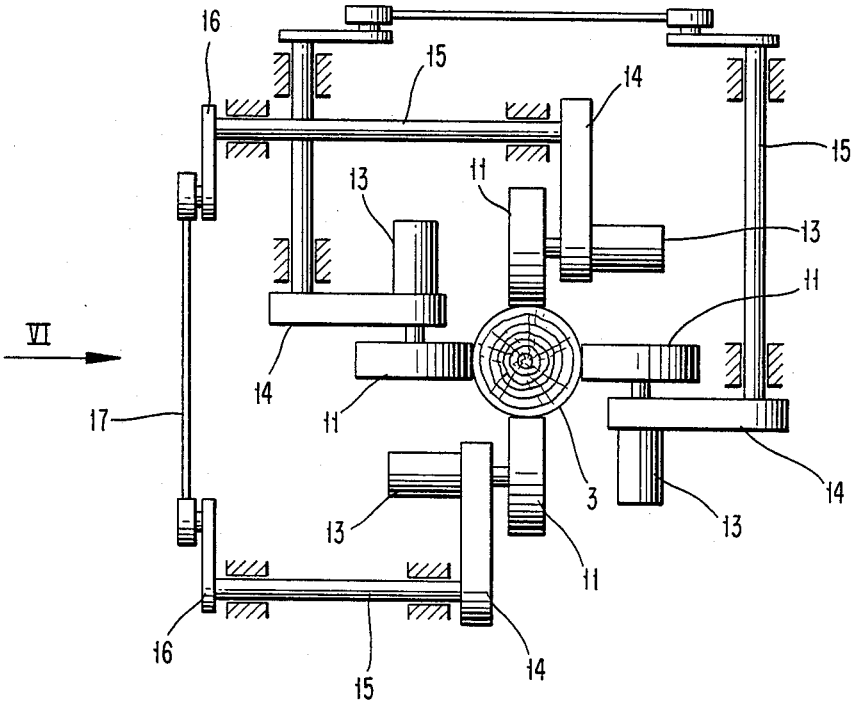
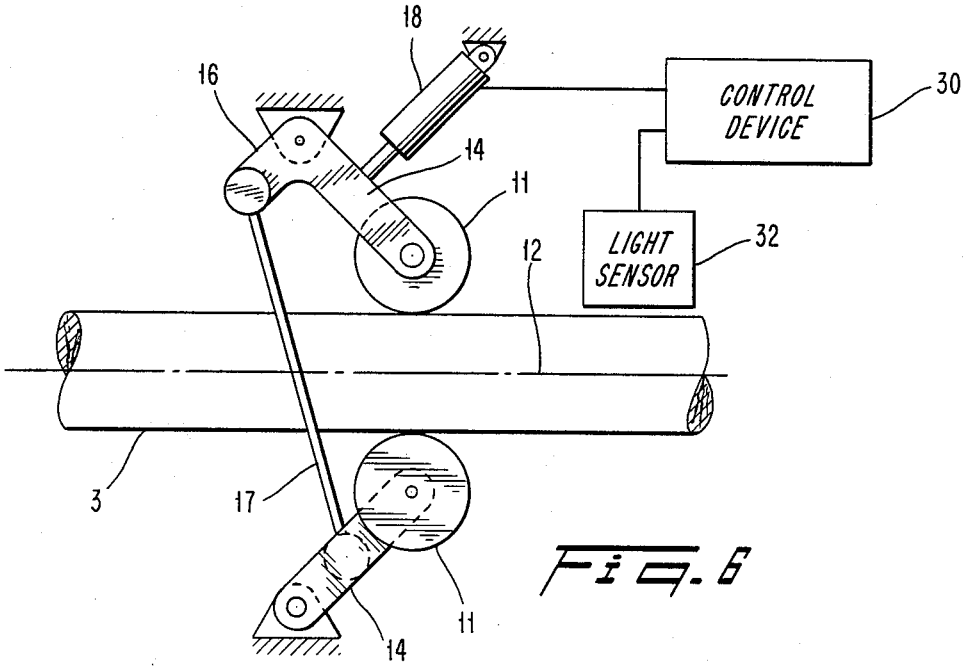
Fig. 6

PROCESS AND APPARATUS FOR THE FEEDING OF TREE TRUNKS TO A PROCESSING MACHINE

BACKGROUND OF THE INVENTION

The invention concerns the feeding of tree trunks to a processing machine by means of centering elements adjustable symmetrically relative to the center feed line, wherein prior to the entry into the processing machine several opposing guide surfaces are cut on the tree trunk, which immediately thereafter enter into contact with guide elements.

Tree trunks, which in processing machines, such as sawing machines and profile molding machines, are to be cut into squared timber, boards and optionally usable chips, must be fed to the processing machine in a straight line, wherein the center feed line is to coincide as accurately as possible with the center line of the tree trunk in order to make possible an optimum utilization of the wood. In the course of the feeding process the swinging motions of the tree trunk must be extensively eliminated, as otherwise the cuts do not follow a straight line.

In order to make possible the straight line feeding of tree trunks to a processing machine, it is known to initially cut guide surfaces on the tree trunk, which extend in a straight line and make possible the straight line guidance of the tree trunk via these guide surfaces. While the presence of such guide surfaces eliminates the difficulties resulting from the conical and usually curving shape of the outer surfaces of the tree trunks as the tree trunk passes through the processing machine, there exists a problem in keeping the tree trunk centered while the guide surfaces are being cut.

In a known process disclosed in German Patent 2921458, the tree trunks are gripped in their central area and at their end by centeringly adjustable clamping tools supported on slides displaceable on a rail. The tree trunk gripped in this manner is fed to milling cutters which mill the guide surfaces by which the tree trunk is subsequently guided by means of guide rolls. As soon as the front end of the tree trunk is taken up by these guide rolls, the center clamping tool opens and the tree trunk is then guided between the guide rolls and by the rear clamping tool. The tree trunk guided and partially processed in this manner is transported to a processing installation, in which the outside of the trunk is milled cylindrically. It is then additionally supported on this cylindrical surface, while the trunk processed on all sides is passed to several forward feed rolls located at in the inlet of a subsequent processing machine, for example a saw.

The apparatus required for this known process is relatively complicated. The longitudinally displaceable slides carrying the clamping tools must be returned into their initial position following the passage of a tree trunk and loaded, before they are able to feed in the next tree trunk. This places narrow limits on the possible rate of operation. To make possible the accurate guidance of the tree trunk at the inlet of the processing machine, the known process requires that the guide surfaces be cut in two successive processing steps, i.e. once for the initial guidance of the front end of the tree trunk, and secondly to obtain the cylindrical outer surface prior to the inlet to the group of guide rolls in front of the processing machine.

It is therefore the object of the invention to provide a process and apparatus which makes it possible to guide tree trunks to a processing machine rapidly and accurately and in a simplified manner.

SUMMARY OF THE INVENTION

This object is attained according to the invention by that a plurality of groups of centering rolls, at least some of which being driven, are controlled during the introduction of a tree trunk in such manner that the centering rolls of the groups arranged to support the front and rear ends of a tree trunk are arranged in trunk centering modes, while the centering rolls of other groups disposed therebetween are in retracted or noncentering modes.

In contrast to the prior art clamps which travel with the tree trunk, in the process according to the present invention the locations of the individual groups of centering rolls are stationary. The points along the trunk travel path at which the centering rolls support the tree trunk are progressively changed. Support of the trunk is applied during the entire feeding process, i.e. each of the groups of centering rolls through which the end of the trunk is passing, guides and supports at some moment during advancement of the trunk. The front end of the trunk is supported and guided by the groups of centering rolls through which it is passing only until it is introduced into a cutting station cutting the guide surfaces, which immediately afterwards are supported by guide elements.

Due to this feeding movement the tree trunk may be transported immediately and without the need of again gripping it between guide rolls to the processing machine such as a saw. The entire working process may be made continuous, as the rear end of a trunk may be followed directly by the front end of a subsequent trunk. In this manner, very high operating rates may be obtained.

It is known to use centering rolls in the feeding of tree trunks to processing machines, which rolls are aligned centeringly from opposite sides (see German OS-16 28 866). The centering rolls are arranged in two stationary groups, through which the tree trunk is passing. If the trunk is curved, it performs a swinging motion in the process.

It is known further to provide an elevating roller bed in feeder installations of wood processing machines, which bed carries the tree trunk (see German OS 32 46 969). The tree trunk is guided along its lower generating line, so that generally no centering alignment relative to the center feed line of the processing machine is possible.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 5 is a cross-section taken along the line V—V in FIG. 4 and FIG. 6 is a fragmentary view in the direction of the arrow VI in FIG. 5.

DETAILED DESCRIPTION OF A PREFERRED EMBODIMENT OF THE INVENTION

Figure 1:
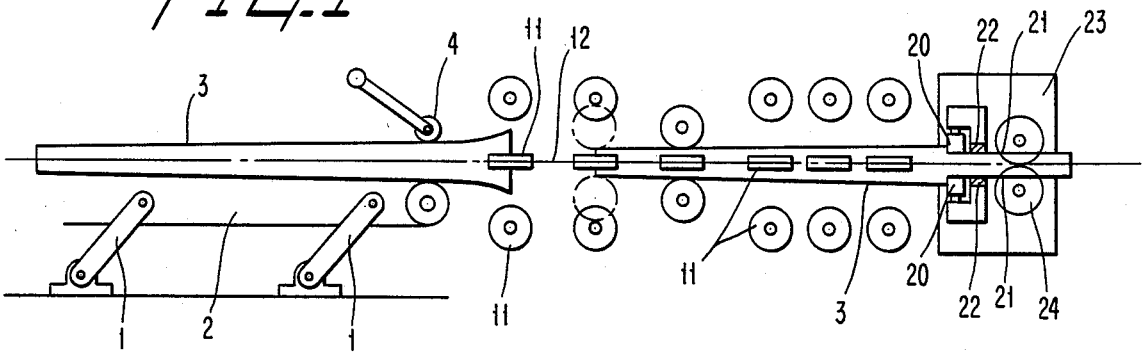
FIG. 1 shows schematically in side elevation an apparatus for the feeding of tree trunks to a saw.
Figure 2:
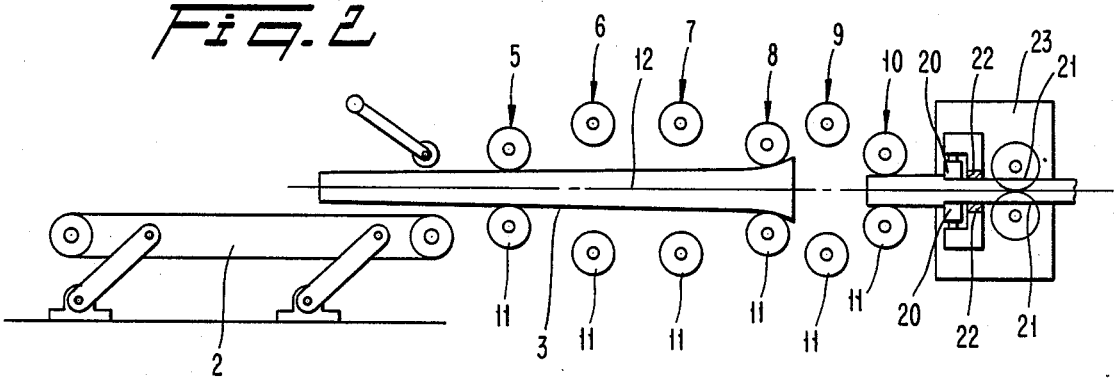
FIGS. 2–4 are similar to FIG. 1 and depict successive steps in the feeding process.

The feeding apparatus shown in the drawing comprises a driven chain conveyor 2 suspended on parallel guide rods 1, whereby a tree trunk 3 to be processed is brought in. Over the discharge end of the chain conveyor 2 a scanning roll 4 is mounted in a height displaceable manner and is connected with a measuring device (not shown). When a tree trunk 3 is present in the position shown in FIG. 1 on the chain conveyor 2, the conveyor is raised until a signal emitted by the scanning roll 4 indicates that the center of the tree trunk 2 is aligned approximately in the center feeding line 12. With the conveyor disposed at that elevation, the tree trunk 3 is transported further. As shown in FIG. 2, the tree trunk 3 passes through several successive groups 5–10 of centering rolls 11, the rolls of each group able to be adjusted symmetrically toward and away from the feeder center line 12.

FIG. 5 shows that every group 5–10 of centering rolls 11 comprises two pairs of diametrically opposed centering rolls 11. Each of the centering rolls 11 driven individually by a drive motor 13 and is supported on a pivot arm 14 attached to a swivel shaft 15. The swivel shafts 15 of opposing centering rolls 11 are connected with each other by means of crank arms 16 and a common guide rod 17. A pressure actuated cylinder 18 drives the interconnected opposing centering rolls 11 in opposing adjusting motions symmetrically relative to the feeder center line 12 (FIG. 6).

A control device 30 (FIG. 6) receives a signal indicating the instantaneous position of the onset and the end of the trunk. This signal may be provided for example by several light barrier type sensors 32, arranged along the path of the tree trunk 3. As an alternative, it is also possible to determine the prevailing position of the beginning and the end of the trunk by a computer following the detection of an initial position.

The control device 30 controls the cylinder 18 for the adjusting movement of the centering rolls in a manner such that whichever centering rolls 11 of the groups 5–10 are located for supporting the front and rear ends of the trunk are adjusted inwardly to their trunk centering positions, while the remaining centering rolls 11 are located in their outwardly retracted trunk non-centering positions, out of contact with the tree trunk 3.

It is thus seen that in FIG. 2 that the centering rolls 11 of the groups 8 disposed at the front end of the trunk are in their trunk centering positions. The centering rolls of Group 10 are similarly disposed and guide the rear end of the preceding trunk. The centering rolls of Group 5 are in their trunk centering positions, because they are the rearmost rolls capable of supporting the rear end of the trunk 3 from the chain conveyor 2.

Figure 3:
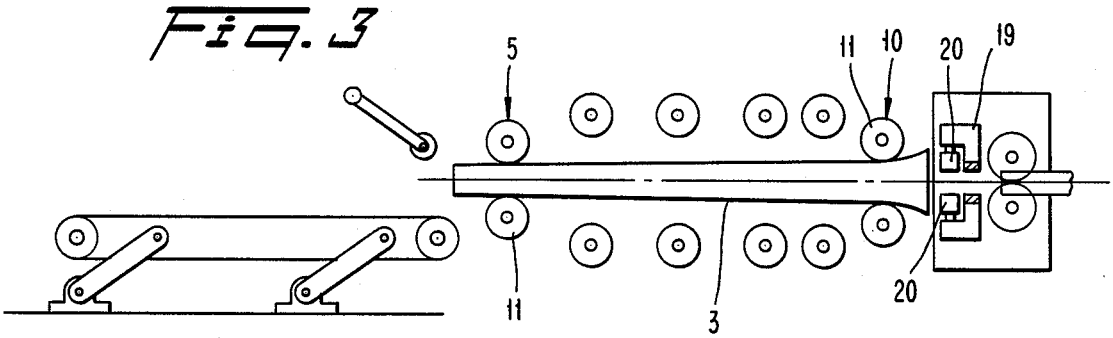
Figure 4:
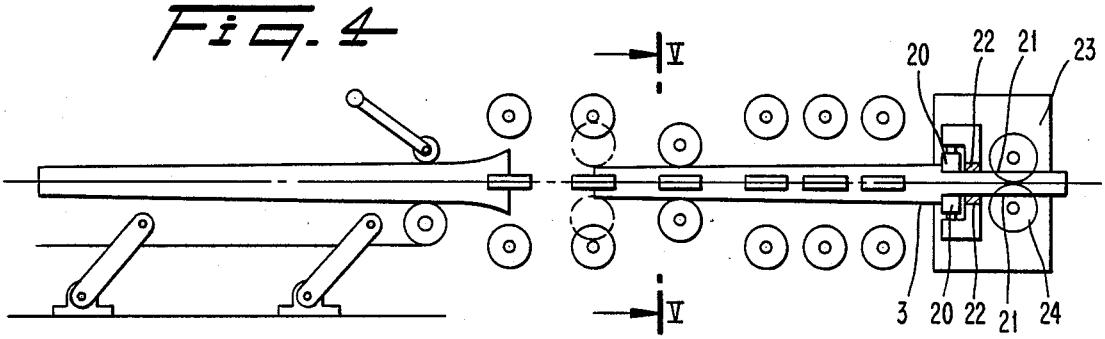

In the state shown in FIG. 3 the tree trunk 3 is gripped between the centering rolls 11 of the foremost Group 10 at the front end of the trunk and between the centering rolls 11 of the rearmost Group 5 at which still support the rear end of the trunk. In this position the tree trunk begins to enter a cutting station 19, wherein a plurality of opposing milling cutters 20 cut opposing guide surfaces 21 into the tree trunk 3 (FIG. 4). Immediately downstream of the cutters 20, the guide surfaces are supported and guided by guide bodies 22.

Directly afterwards the tree trunk 3 enters a processing machine 23, which in the disclosed embodiment shown comprises a plurality of circular saws, which cut the tree trunk into log or beam timber or boards. While the tree trunk is passing through the processing machine 23, it is being guided immediately upstream by the guide bodies 22 and at its rear end by whichever centering rolls are arranged to support the rear end at any given instant.

The milling cutters may also be laid out and applied in a manner such that they cut four longitudinal edges into the tree trunk 3, which serve as guide surfaces for the subsequent guide bodies 22 and which in the sawing process also form the edges of the lateral boards.

As seen in the drawing, the tree trunk 3 is being guided with its root end forward. The top end of the trunk is in most cases straight, while the root end frequently extends laterally. The centering of the tree trunk 3 thus takes place at the straight top end, as the preceding root end is being cut laterally at the onset of the feeder process by the milling cutters 20.

The guide bodies 22 may be replaced by guide rolls, if the forces applied by the subsequent processing tools 24 are approximately equalized. In the case of unilaterally higher processing forces the guide bodies 22 are more suitable for guidance and lateral support.

It has been mentioned in the foregoing description of a preferred embodiment that the centering rolls 11 which are in a non-centering mode, i.e., which perform no guiding function for the tree trunk 3, are retracted. Instead, however, these centering rolls may be merely relieved of stress i.e., unloaded; thus, in their non-centering mode, the centering rolls are applied to i.e., in contact with, the trunk 3 but apply no lateral forces to the trunk and thus have no guiding function.

In place of the arrangement previously described wherein four centering rolls 11 are disposed in each group 5–10, different numbers of centering rolls 11 may also be chosen, for example three centering rolls 11 distributed uniformly over the circumference of the tree trunk. It is also possible to effect the centering in one plane only, preferably in the horizontal plane, wherein in each group 5–10 always only two opposing centering rolls 11 are provided, while the tree trunk 3 is located and transported on a chain conveyor, roll conveyor of similar horizontal guiding means.

What is claimed:

1. In a process of feeding tree trunks to a processing machine, the process including the step of cutting guide surfaces into the tree trunk at a cutting station disposed upstream of the processing machine whereafter the guide surfaces are engaged and supported by guide elements disposed between the cutting station and the processing machine, the improvement comprising centering the tree trunk along a centering line of the processing machine during the delivery of a tree trunk to the cutting station by the steps of:

providing groups of centering rolls upstream of said cutting station, said groups being spaced along said centering line, centering rolls of each said group being adjustable symmetrically between trunk centering and trunk non-centering modes, at least some of said centering rolls being driven to advance a tree trunk, and advancing the tree trunk along said centering line successively through said groups of centering rolls while successively adjusting said groups between their centering and non-centering modes such that groups thereof located to support front and rear ends of the advancing tree trunk are in their centering modes while at least one group disposed therebetween is in a non-centering mode.

2. A method according to claim 1, wherein said groups are adjusted to their non-centering modes by being displaced out of contact with the tree trunk.

3. A method according to claim 1 including the step of measuring the diameter of a tree trunk before introducing the tree trunk to the groups of centering rolls.

4. A method according to claim 1, wherein a force is applied to said groups for adjusting said groups to their centering modes, said groups being adjusted to their non-centering modes by releasing said force.

5. Apparatus for processing tree trunks comprising a processing machine defining a centering line, cutting means disposed upstream of said processing machine for cutting guide surfaces into a tree trunk, guide elements disposed between said cutting means and said processing machine for engaging and supporting the guide surfaces during travel of a tree trunk to said processing machine, the improvement comprising centering means for centering a tree trunk along said centering line during the delivery of the tree trunk to said cutting means, said centering means comprising:

groups of centering rolls disposed upstream of said cutting means, said groups being spaced along said centering line, centering rolls of each said group being adjustable symmetrically between trunk centering and trunk non-centering modes, means for driving at least some of said centering rolls for advancing a tree trunk successively through said groups of centering rolls, and means for successively adjusting said groups between their centering and non-centering modes such that groups thereof arranged to support front and rear ends of the advancing tree trunk are in their centering modes while at least one group disposed therebetween is in a non-centering mode.

6. Apparatus according to claim 5, wherein said rolls of each group of rolls are adjustable away from said centering line to positions out of contact with a tree trunk to define said non-centering mode.

7. Apparatus according to claim 5 including a conveyor disposed upstream of said groups of rolls.

8. Apparatus according to claim 5, wherein said group comprises two pairs of diametrically opposed rolls.

9. Apparatus according to claim 6 including means mechanically interconnecting a plurality of rolls of each group for achieving simultaneous movement thereof toward and away from said centering line.

* * * * *